US008308389B2

(12) United States Patent
Yu

(10) Patent No.: US 8,308,389 B2
(45) Date of Patent: Nov. 13, 2012

(54) APPARATUS AND RELATED METHODS FOR APPLYING CAULK, SEALANT, GROUT, OR SIMILAR COMPOUNDS

(76) Inventor: David Chen Yu, Laguna Niguel, CA (US)

( * ) Notice: Subject to any disclaimer, the term of this patent is extended or adjusted under 35 U.S.C. 154(b) by 474 days.

(21) Appl. No.: 12/651,596

(22) Filed: Jan. 4, 2010

(65) Prior Publication Data

US 2011/0164917 A1 Jul. 7, 2011

(51) Int. Cl.

| | |
|---|---|
| ***B05C 11/02*** | (2006.01) |
| ***B05C 11/04*** | (2006.01) |
| ***B05C 13/00*** | (2006.01) |
| ***B05C 17/10*** | (2006.01) |
| ***E01C 19/10*** | (2006.01) |

(52) U.S. Cl. ..... 401/261; 401/25; 401/139; 401/264; 401/265; 15/235.4; 15/235.7; 15/245.1; 118/44; 118/56

(58) Field of Classification Search ..... 401/25, 401/139, 261, 264, 265; 15/235.4, 235.7, 15/245.1; 118/44, 56

See application file for complete search history.

(56) References Cited

U.S. PATENT DOCUMENTS 1,297,361 A * 3/1919 Kerner ..... 401/261
2,804,767 A * 9/1957 Schoen ..... 401/9
5,075,916 A * 12/1991 Englehart ..... 15/245.1
5,413,258 A * 5/1995 Kartler ..... 222/575
5,865,555 A * 2/1999 Dawson ..... 401/266
6,219,878 B1 * 4/2001 Dewberry ..... 15/235.7

OTHER PUBLICATIONS

National Express Online, ProCaulk Caulking Kit—Official TV Site Website, URL: BuyProCaulk.com, Accessed on Mar. 31, 2010.

* cited by examiner

*Primary Examiner* — David Walczak
*Assistant Examiner* — Joshua Wiljanen
(74) *Attorney, Agent, or Firm* — Tran & Associates

(57) ABSTRACT

An apparatus for use when applying a compound from a dispensing tube comprises: a receptacle; a plurality of retaining rings mechanically coupled to the receptacle for attaching the apparatus to the dispensing tube; an application blade secured within the receptacle for contacting the compound being dispensed during application; optionally, a handle mechanically coupled on an opposite side of the receptacle from the plurality of retaining rings; and, optionally, at least one retaining clip for securing at least one of the plurality of retaining rings around a nozzle tip of the dispensing tube. Such apparatus and related methods facilitate initial application of the compound in an evenly distributed and desired topographical manner without requiring subsequent smoothing and/or shaping steps after contact of the compound with a surface to which it is applied.

15 Claims, 4 Drawing Sheets

APPARATUS AND RELATED METHODS FOR APPLYING CAULK, SEALANT, GROUT, OR SIMILAR COMPOUNDS

BACKGROUND OF THE INVENTION

The present invention pertains to an apparatus and related methods for applying caulk, sealant, grout, or similar compounds.

Caulk, sealant, grout, and similar compounds are commercially available in standard-sized dispensing tubes. Conventional dispensing tubes for such compounds are typically designed so that the compounds therein are either readily dispensable by hand, as in the case of a hand-squeezable tube, or readily dispensable using an apparatus, such as a caulking gun. A hand-squeezable tube is generally cylindrical in shape, with a narrow cone-shaped nozzle tip on one end and a flat seal on an opposing end. A larger-sized version of a dispensing tube typically consists of a generally cylindrical tube with a movable circular base sealing one end of the tube and a narrow cone-shaped nozzle tip on the opposing end. The larger-sized version typically requires the use of an external apparatus, such as a caulking gun, for application of the compound therein. Conventional apparatus for use with the larger-sized dispensing tubes generally comprise a spring-loaded manual trigger, which trigger drives a threaded plunger rod into the circular base of the caulk tube and toward the opposing end of the tube. When triggered as such, compound within the tube is expelled from the nozzle tip.

While such dispensing tubes enjoy widespread use, compounds dispensed from the same are often topographically undesirable (e.g., they are lumpy) or otherwise unevenly distributed and require smoothing or other shaping after their initial application. Often such shaping is performed by one applying the compound using their finger to smooth or otherwise shape the applied compound for aesthetic and/or functional purposes. This is needlessly an imperfect, and often messy, solution.

Further apparatus are desirable for use in applying caulk, sealant, grout, or similar compounds. Particularly desirable are apparatus for use in applying such compounds in an evenly distributed and desired topographical manner.

SUMMARY OF THE INVENTION

The present invention provides for an efficient and convenient apparatus for the application of caulk, sealant, grout, or similar compounds, particularly apparatus for use in applying such compounds in an evenly distributed and desired topographical manner. Apparatus of the invention are capable of being efficiently and securely attached to a nozzle tip on most commercially available caulk, sealant, or grout tubes—whether such tubes be of the hand-squeezable type or the larger-sized dispensing tube requiring application with an external apparatus.

According to the invention, an apparatus for use when applying a compound from a dispensing tube comprises: a receptacle; a plurality of retaining rings mechanically coupled to the receptacle for attaching the apparatus to the dispensing tube; an application blade secured within the receptacle for contacting the compound during application; optionally, a handle mechanically coupled on an opposite side of the receptacle from the plurality of retaining rings; and, optionally, at least one retaining clip for securing at least one of the plurality of retaining rings around a nozzle tip of the dispensing tube. Such apparatus and related methods facilitate initial application of the compound in an evenly distributed and desired topographical manner without requiring subsequent smoothing and/or shaping steps after contact of the compound with a surface to which it is applied.

BRIEF DESCRIPTION OF THE SEVERAL VIEWS OF THE DRAWINGS

The present invention described herein will become apparent from the following detailed description considered in connection with the accompanying drawings, which disclose several embodiments of the invention. It should be understood, however, that the drawings are designed for the purpose of illustration and not as limits of the invention.

DETAILED DESCRIPTION OF THE INVENTION

Figure 1A:
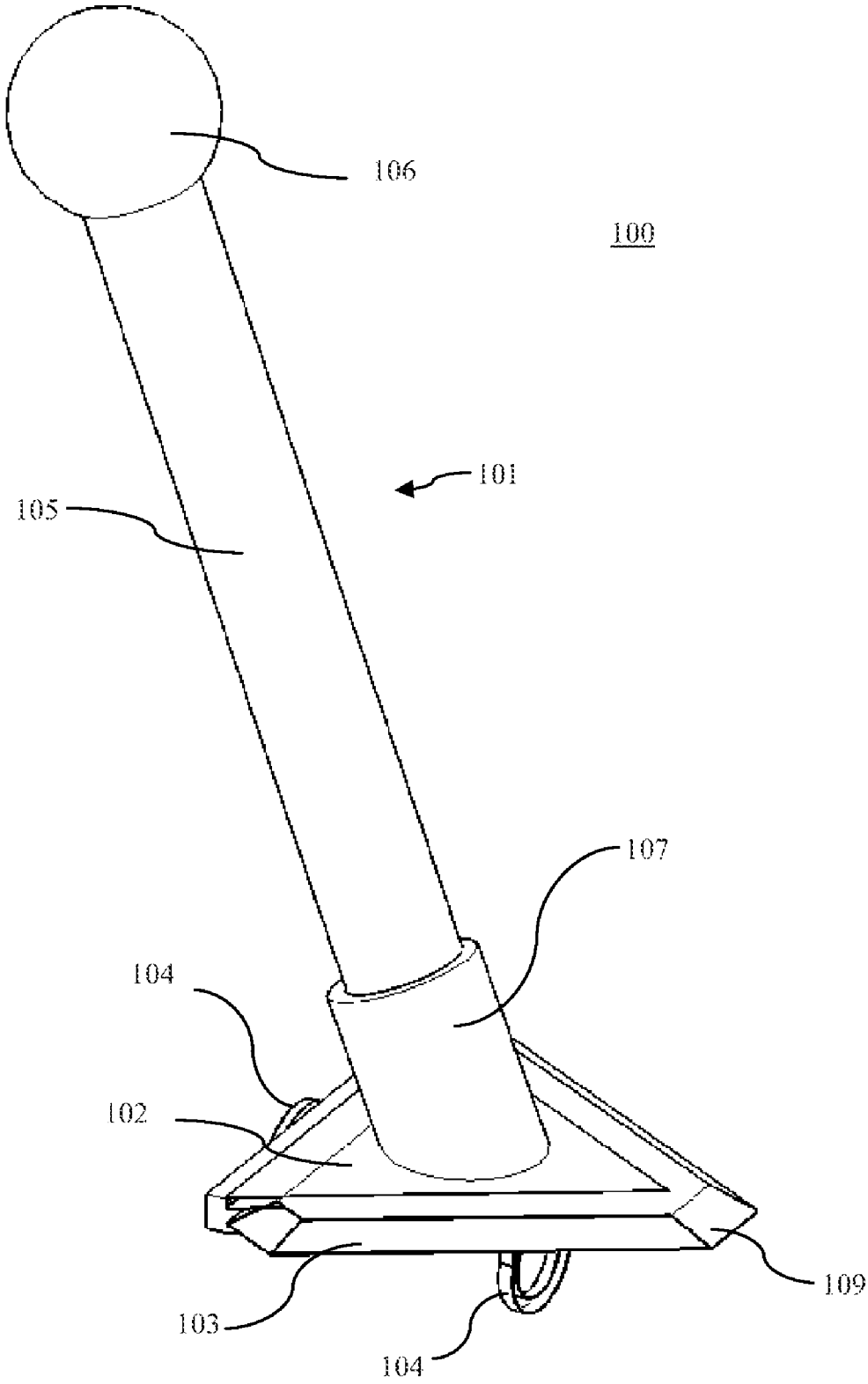
FIG. 1A is a perspective view of one embodiment of an apparatus for applying caulk, sealant, grout or similar compounds according to the invention.

The present invention provides an efficient and convenient apparatus for the application of caulk, sealant, grout, or similar compounds, particularly apparatus for use in applying such compounds in an evenly distributed and desired topographical manner. Apparatus of the invention are capable of being efficiently and securely attached to a nozzle tip on most commercially available caulk, sealant, or grout tubes—whether such tubes be of the hand-squeezable'type or the larger-sized dispensing tube requiring application with an external apparatus. When apparatus of the invention are attached to the larger-sized dispensing tubes, conventional dispensing apparatus (e.g., caulk guns) for application of compounds from such tubes are used in conjunction therewith. Apparatus of the invention easily attach to the nozzle tip of conventional dispensing tubes, whether or not such dispensing tubes also have a caulk gun or similar apparatus attached thereto.

Apparatus of the invention generally comprise a receptacle; a plurality of retaining rings mechanically coupled to the receptacle for attaching the apparatus to a dispensing tube; an application blade secured within the receptacle for contacting a compound dispensed from the tube during application; optionally, a handle mechanically coupled on an opposite side of the receptacle from the plurality of retaining rings; and, optionally, at least one retaining clip for securing at least one of the plurality of retaining rings around a nozzle tip of the dispensing tube. By contacting a compound being applied to a surface from a dispensing tube, the application blade facilitates smoothing and/or otherwise shaping of caulk, sealant, grout, or similar compounds during their initial application.

According to one embodiment, the application blade is removable. According to a further embodiment, the application blade is interchangeable with other application blades (e.g., those of various shapes and/or sizes) to accommodate different types of compounds or applications. For example, using apparatus of the invention, compounds are capable of being smoothly applied to an angled surface, e.g., the angled intersection of two planed surfaces, or a planar surface. The shape of the application blade is selected based on the desired application. Exemplary shapes for application blades according to the invention include those with pointed ends (e.g., with the application blade having a generally triangular shape at least on one end where it contacts the compound being applied) and those with squared ends (e.g., with the application blade having a generally rectangular shape at least on one end where it contacts the compound being applied). An application blade with squared ends can be effectively used, for example, when applying the compound to fill a groove between two planed surfaces.

Advantageously, apparatus of the invention facilitate initial application of compounds in an evenly distributed and desired topographical manner. Subsequent smoothing and/or shaping steps are not required after contact of the dispensed compound with a surface to which it is applied. Apparatus of the invention are capable of being easily used by contacting the surface with a bead of compound from a conventional dispensing tube and applying force on the top of the receptacle and/or through the optional handle in order to evenly distribute the force across the application blade while pulling both the apparatus and the dispensing tube together in a desired application direction. This method and apparatus of applying caulk, sealant, grout, or similar compounds facilitates application in an evenly distributed and desired topographical manner.

Figure 1B:
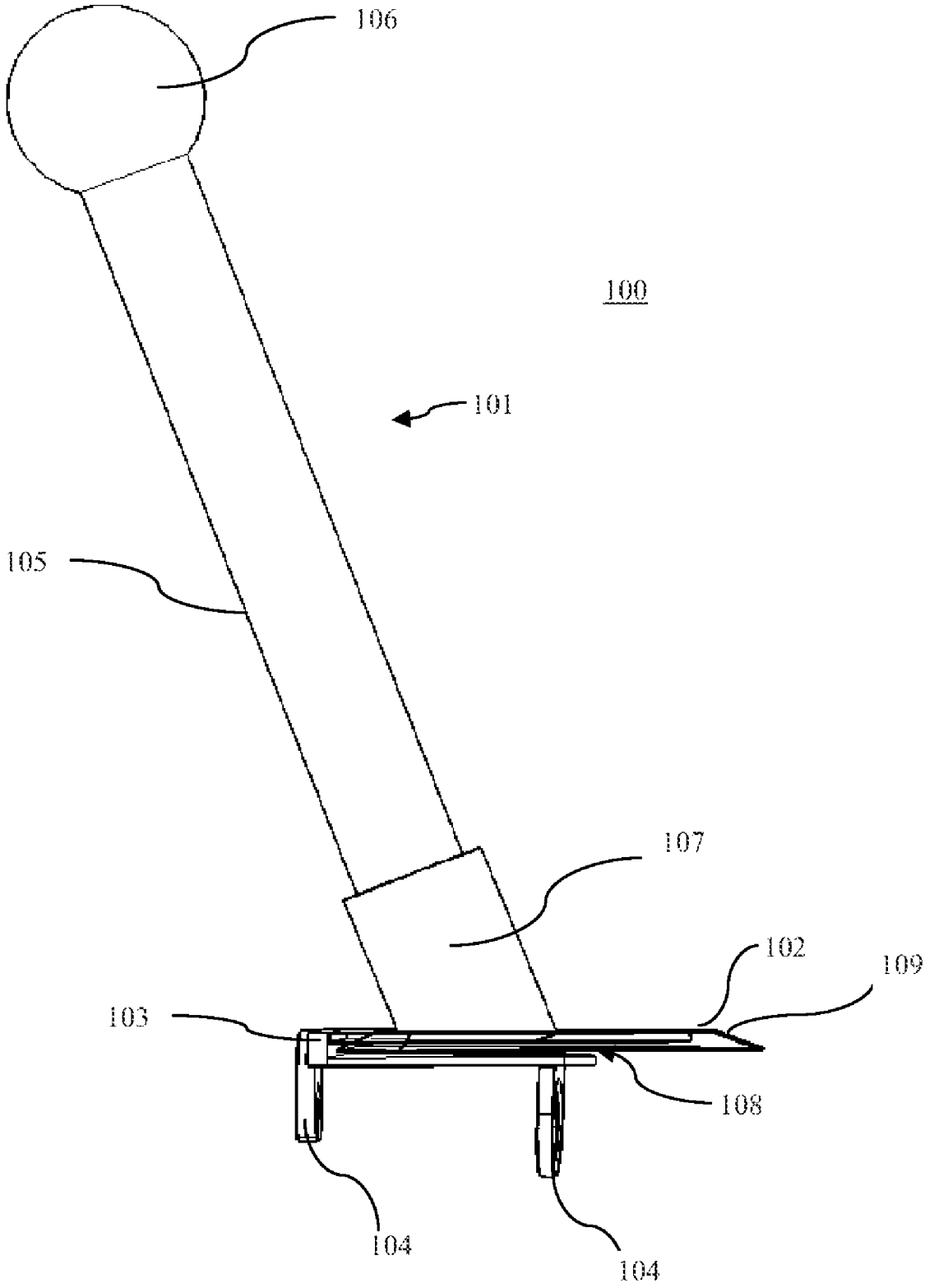
FIG. 1B is a side perspective view of the apparatus of FIG. 1A.

As illustrated in FIGS. 1A and 1B, an exemplary apparatus 100 of the invention attaches to the nozzle of a dispensing tube and comprises the following: a handle 101, a receptacle 102, an application blade 103, and a plurality of retaining rings 104.

The handle 101, which is not required in all embodiments of apparatus of the invention, is constructed to allow a user to grip and hold the apparatus 100. The handle 101 comprises a rod 105 extending from the receptacle 102. In one embodiment, when attached to a dispensing tube, the handle 101 is angled with respect to a longitudinal axis extending through the dispensing tube in order to increase leverage of a user directing the apparatus 100. In one embodiment, the handle 101 comprises a spherical grip 106 on an end of the rod 105 opposite the receptacle 102 in order to accommodate a base of a user's hand.

The handle 101 comprises any suitable material. In an exemplary embodiment, the handle 101 comprises a material providing a frictional gripping force between a user and the handle 101.

As illustrated in FIGS. 1A and 1B, the handle 101 is mechanically coupled to a first side of the receptacle 102. According to one embodiment, the handle 101 and the receptacle 102 are formed as a single piece. According to another embodiment, the handle 101 and the receptacle 102 are formed as two discrete components, which are then mechanically coupled when forming the apparatus 100. The one or multiple components of the handle 101 may be formed using any suitable methodology. In an exemplary embodiment, the components are formed by molding the same.

The receptacle 102 comprises any suitable shape for providing a safe and functional coupling between the handle 101 and the application blade 103. In the exemplary embodiment illustrated, the receptacle 102 comprises a flat, triangular shape with a base 107 for the handle 101 and a narrow slot 108 across its horizontal plane. The narrow slot 108 allows an application blade 103 to be inserted and, preferably, removably, secured in the receptacle 102.

The receptacle 102 comprises any suitable material. In an exemplary embodiment, the receptacle 102 comprises a metallic or durable plastic material.

The application blade 103 comprises any suitable shape for contacting and shaping and/or smoothing as desired the compound being applied from a dispensing tube to which the apparatus 100 is attached when used. For example, the application blade 103 comprises a flat, triangular-shaped plane in the embodiment illustrated in FIGS. 1A and 1B. In a further embodiment, such as that also illustrated in FIGS. 1A and 1B, the application blade 103 comprises a beveled surface to provide a sharp edge across a flattened point 109. Width of the flattened point 109 may vary to accommodate desired shaping profiles for the applied compound. In an exemplary embodiment, the application blade 103 is interchangeable to accommodate the desired shaping profile.

The application blade 103 comprises any suitable material. In an exemplary embodiment, the application blade 103 comprises a metallic or durable plastic material.

A second side of the receptacle 102, opposite the handle 101, comprises a plurality of retaining rings 104. When attached to a dispensing tube, the plurality of retaining rings 104 of the apparatus 100 surround the dispensing tube's nozzle tip and secure the apparatus 100 thereto.

In a further embodiment, one or more of the plurality of retaining rings 104 is optionally further secured around the nozzle tip using a retaining clip. Each of the plurality of retaining rings 104 and the optional retaining clip comprises any suitable material. In an exemplary embodiment, each of the plurality of retaining rings 104 comprises a metallic or durable plastic material. In an exemplary embodiment, the retaining clip comprises a metallic or elastic material.

Figure 1C:
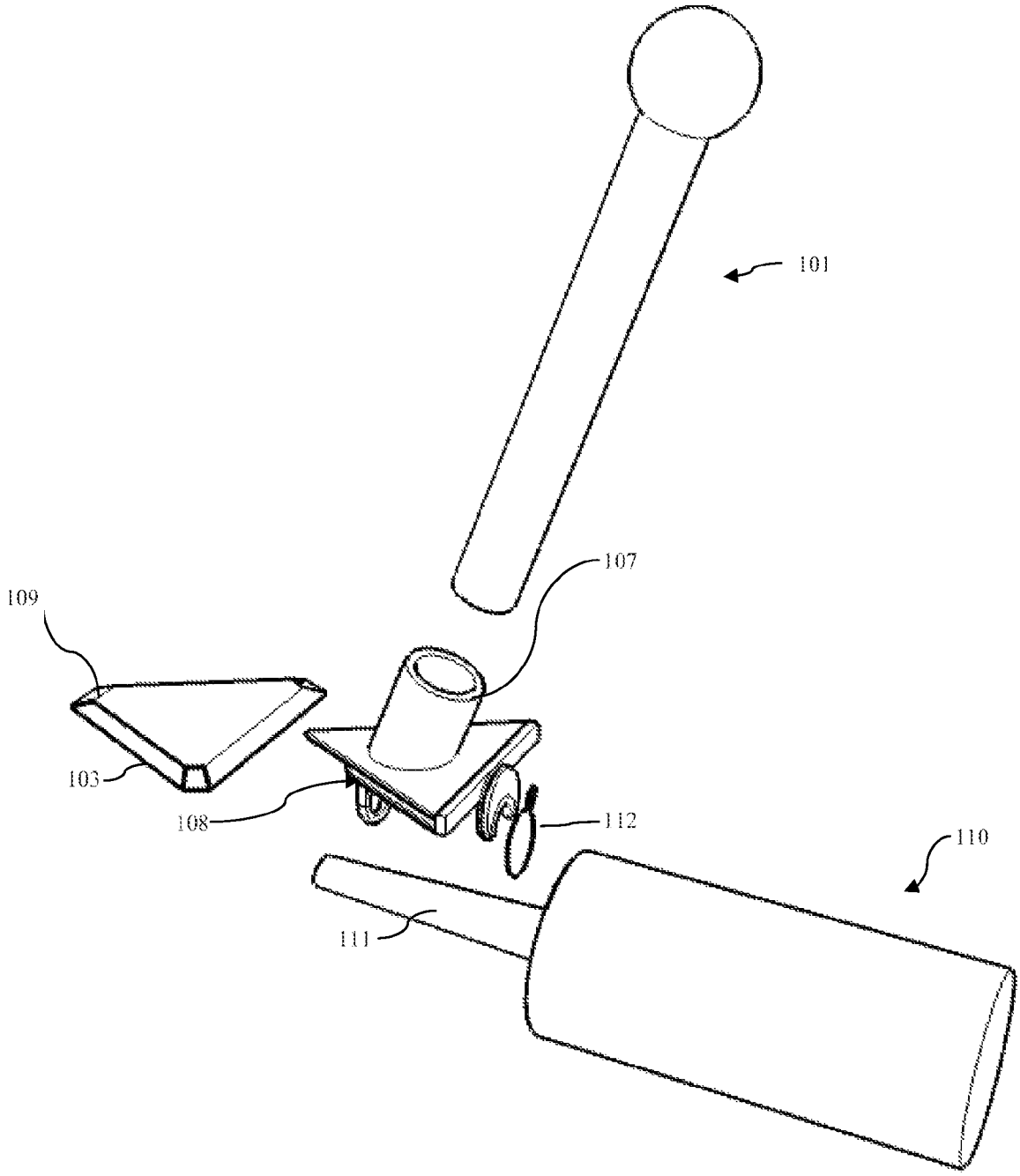
FIG. 1C is an exploded view of various components of the apparatus of FIG. 1A attached to a caulk tube.

FIG. 1C is an exploded view of various components of the apparatus of FIGS. 1A and 1B when attached to a dispensing tube 110. As illustrated therein, the apparatus 100 attaches to the nozzle tip 111 of a dispensing tube 110. The nozzle tip 111 of the dispensing tube 110 is inserted into the plurality of retaining rings 104 of the apparatus 100. A retaining clip 112 is inserted around the nozzle tip 111 and attaches to at least one of the plurality of retaining rings 104. Positioning of the apparatus 100 over the nozzle tip 111 as illustrated in FIG. 1C allows the application blade 103 to be positioned above and approximately aligned with a narrow end of the nozzle tip 111. This allows the application blade 103 to smooth and/or otherwise shape compound (e.g., caulk) as it is being dispensed from the dispensing tube 110 and applied to a surface.

Figure 2:
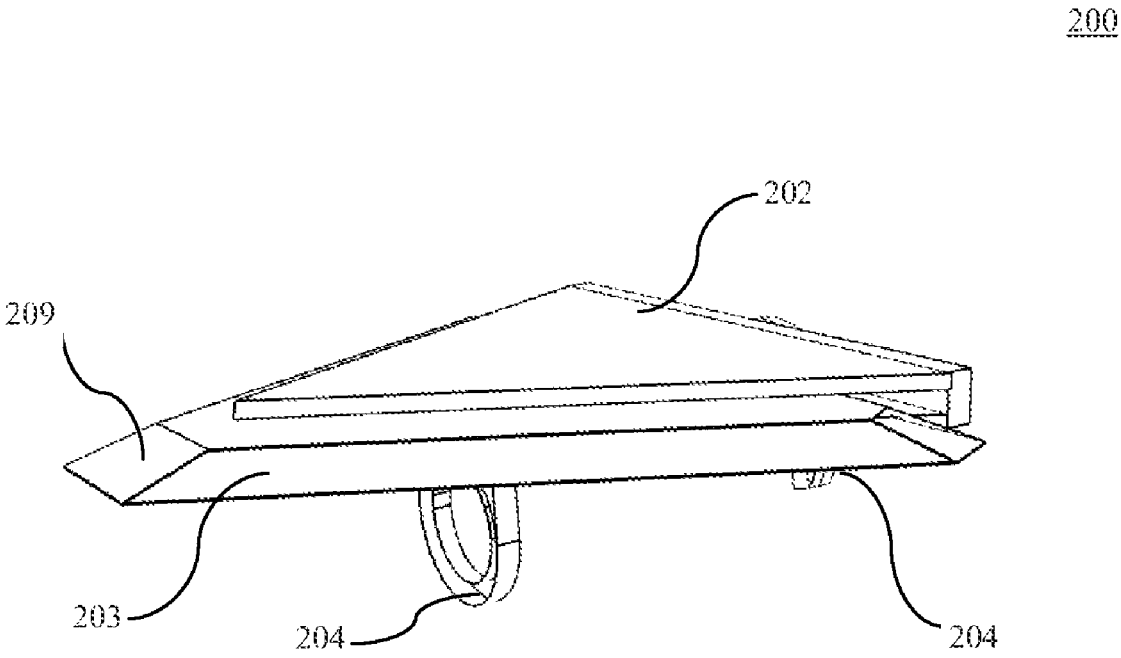
FIG. 2 is a side perspective view of another embodiment of an apparatus for applying caulk, sealant, grout or similar compounds according to the invention.

FIG. 2 is a perspective view of another embodiment of the invention, wherein the apparatus 200 does not include a handle. According to the embodiment illustrated in FIG. 2, the exemplary apparatus 200 comprises: a receptacle 202, an application blade 203, and a plurality of retaining rings 204. The application blade 203 comprises a beveled surface to provide a sharp edge across a flattened point 209. Width of the flattened point 209 may vary to accommodate desired shaping profiles for the applied compound. In an exemplary embodiment, the application blade 203 is interchangeable to accommodate the desired shaping profile. One or more of the plurality of retaining rings 204 may be optionally secured around a dispensing tube's nozzle tip using at least one retaining clip. Applying a compound to a surface using the exemplary apparatus in FIG. 2 can be accomplished by contacting a surface with a bead of the compound from the dispensing tube and applying force on top of the receptacle 202 in order to evenly distribute the force across the application blade 203 while pulling both the apparatus 200 and the dispensing tube together in a desired application direction.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

What is claimed is:

1. An apparatus for use when applying a compound from a dispensing tube for containing a compound comprising:

a receptacle;

a plurality of retaining rings mechanically coupled to the receptacle for attaching the apparatus to the dispensing tube;

an application blade secured within the receptacle for contacting the compound dispensed from the tube during application;

a handle mechanically coupled on an opposite side of the receptacle from the plurality of retaining rings; and at least one retaining clip for securing at least one of the plurality of retaining rings around a nozzle tip of the dispensing tube, wherein the retaining rings are on a second side of the receptacle opposite the handle and when attached to the dispensing tube, the plurality of retaining rings surround the dispensing tube's nozzle tip and wherein one or more of the plurality of retaining rings is secured around a nozzle tip using one retaining clip.

2. The apparatus of claim 1, wherein the handle comprises a rod with a spherical grip on a side of the rod opposite the receptacle.

3. The apparatus of claim 1, wherein the handle is angled with respect to a longitudinal axis extending through the dispensing tube.

4. The apparatus of claim 1, wherein the receptacle comprises a flat, triangular shape with a base for the handle and a narrow slot across its horizontal plane for insertion of the application blade therein.

5. The apparatus of claim 1, wherein the application blade is removable.

6. The apparatus of claim 1, wherein the application blade is interchangeable with a replacement blade.

7. The apparatus of claim 1, wherein the application blade comprises a triangular-shaped plane.

8. The apparatus of claim 1, wherein the application blade comprises a beveled surface to provide a sharp edge across a flattened point.

9. The apparatus of claim 1, wherein the receptacle comprises a slot for insertion of the application blade therein.

10. The apparatus of claim 1, wherein the application blade facilitates initial application of the compound dispensed from the tube in an evenly distributed and desired topographical manner without requiring subsequent smoothing and/or shaping steps after contact of the compound with a surface to which it is applied.

11. A method for applying a compound from a dispensing tube, the method comprising:

providing the apparatus of claim 1;

attaching the apparatus to the dispensing tube; and applying the compound dispensed from the tube to a surface.

12. The method of claim 11, wherein the step of applying the compound to a surface comprises contacting the surface with a bead of the compound from the dispensing tube and applying force on top of the receptacle in order to evenly distribute the force across the application blade while pulling both the apparatus and the dispensing tube together in a desired application direction.

13. The method of claim 11, wherein the compound comprises at least one of caulk, sealant, and grout.

14. The method of claim 11, wherein the dispensing tube comprises a hand-squeezable tube.

15. The method of claim 11, wherein the application blade is positioned above and approximately aligned with a narrow end of the nozzle tip of the dispensing tube.

* * * * *